United States Patent [19]

van Bilderbeek

[11] 4,180,349

[45] Dec. 25, 1979

[54] PILE FORGING

[75] Inventor: Bernard H. van Bilderbeek, Ventura, Calif.

[73] Assignee: Vetco, Inc., Ventura, Calif.

[21] Appl. No.: 873,357

[22] Filed: Jan. 30, 1978

[51] Int. Cl.[2] ..... E02D 5/54

[52] U.S. Cl. ..... 405/224; 405/244

[58] Field of Search ..... 61/89, 53.68, 53, 94, 61/98, 50; 29/523, 507; 405/224, 244

[56] References Cited

U.S. PATENT DOCUMENTS

| | | | |
|---|---|---|---|
| 1,081,496 | 12/1913 | Gillmor | 29/507 |
| 1,242,627 | 10/1917 | Winningham | 29/523 |
| 3,224,204 | 12/1965 | Siebenhauser | 61/89 |
| 3,344,509 | 10/1967 | Kunsagi et al. | 29/523 X |
| 3,412,565 | 11/1968 | Lindsey et al. | 61/53.5 |
| 3,555,831 | 1/1971 | Pogonowski | 61/94 |
| 3,921,427 | 11/1975 | Malone et al. | 72/59 |
| 3,956,818 | 5/1976 | Hauschke et al. | 29/523 |
| 3,995,438 | 12/1976 | Pogonowski | 61/53.68 |

*Primary Examiner*—Mervin Stein

*Attorney, Agent, or Firm*—Subkow and Kriegel

[57] ABSTRACT

An underwater template has one or a plurality of pile housings through which piles are driven into the earth at the floor of the water to fix the template in place by forging the pile into grooves in the housing. The forging operations are performed by a rotary cold forge tool with expansible rollers, the tool being rotatable by a running string of drill pipe guided by a swivel which lands on and is centered by the pile, or the forging is done by explosives confined between seals within the pile section.

1 Claim, 8 Drawing Figures

PILE FORGING

In the drilling, completion and production of offshore wells, in deep water from a platform or vessel on top of the water, it becomes necessary or desirable to install various types of apparatus at the mudline beneath the water. Templates or bases may be fixed on the ocean floor to provide a mounting support for well head equipment, production, service and gathering equipment, and the like.

Typically, the templates or support structures are landed on the floor of the water and have one or more, generally a plurality of pile housings through which piles can be installed in the earth and subsequently connected to the housing. The piles are usually cemented in place in the housings, but the cement does not provide a good interlock between the pile and the housing, and consequently, long pile and housing sections are cemented together.

Where the piles are installed at a known depth in a drilled hole the vertical location of the pile can be established so that a mechanical interlock between the pile and the structure to be connected to it can be easily used or can be used to assist the grout or cement in retaining the parts interlocked. When the piles are driven, however, the vertical position of the pile with respect to the template or other structure or housing is not always predictable, since different piles encounter different formations in the earth with more or less resistance to pile penetration during a given period of driving by applying hammer blows to the pile.

While the practice involving deforming one tubular member into another and, for that matter, the practice of deforming piles with anchored engagement in the earth (U.S. Pat. No. 3,797,259, granted Mar. 19, 1974, for "Method For In-Situ Anchoring Piling") are known, the problems of anchoring underwater templates or frame structures to anchor piles have presisted.

The present invention relates to coupling piles to pile housings or jackets by a forging operation.

More particularly, the pile housing or jacket is internally provided with grooves or lands and the pile section within the housing or jacket is expanded into mechanically interlocked relation in the grooves and with the lands by the application of an internal expansive force initiated or controlled from a remote location, such as from a platform or vessel on top of a body of water.

In the case of one type of apparatus, the pile housing or jacket and the pile are joined together by inserting into the open end of the pile a rotatable, expansible forging tool which is rotated by a length of running pipe and guided by a swivel which engages the end of the pile and rotatably centers the forging tool while allowing the tool to move longitudinally in the pile. Expansible rollers on the tool deform the pile outwardly into grooves in the housing or jacket as the tool is rotated, the longitudinal movement of the tool enabling the deformation of a pile section longer than the rollers, to effect a forged interlock.

In the case of another form of apparatus, an explosive carrying tool, capable of generating high gas pressure is lowered into the pile, and a seal is formed at spaced locations straddling the section of pile to be expanded into interlocked engagement in the housing or jacket. When the explosive is ignited, the contained high gas pressure will cause the pile to be expanded or forged outwardly into grooves in the pile housing.

As one result of the forging operation, shorter pile and housing sections can be interconnected by rigid, forged connections, than can be joined by the usual grouting or cementing techniques, and complicated gripping type connections are not required to fix the pile and housing together.

This invention possesses many other advantages and has other objects which may be made more clearly apparent from a consideration of several forms and methods embodying the invention. These forms and methods are shown and described in the present specification and in the drawings accompanying and constituting a part thereof. They will now be described in detail, for the purpose of illustrating the general principles of the invention; but it is to be understood that such detailed description is not to be taken in a limiting sense.

Referring to the drawings.

Figure 1:
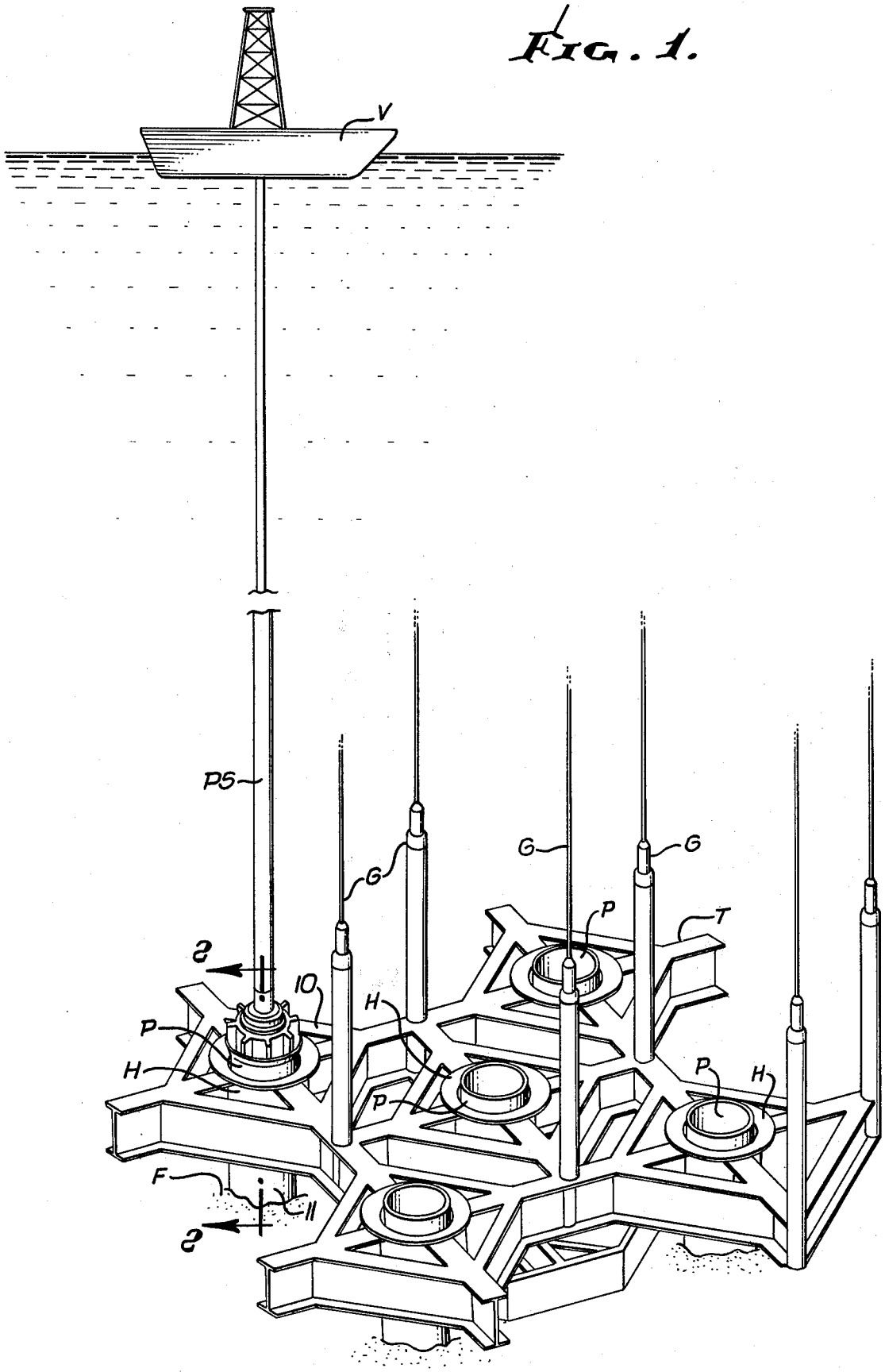
FIG. 1 is a perspective illustrating a subsurface template being installed on the floor of a body of water, in accordance with the invention, from a vessel afloat on the water.

As seen in the drawings, referring first to FIG. 1, a template or frame structure T has been lowered to the floor F of a body of water and provides guide posts and guidelines G enabling the installation on the frame or template of various underwater equipment, such as, for example, a pipeline connector for an underwater gathering system for wells produced through subsea production equipment which may be mounted on other platforms or templates located on the floor at wellheads. The present invention is useful in anchoring by piles all of such templates or frame structures, as well as that illustrated in FIG. 1 by way of example.

The template frame structure has one or more frame sections 10 having centrally thereof a pile housing H, in some or all of which may be installed a pile P which extends through the housing and into the floor F a distance providing a rigid anchor for the template structure T when the housing or housings and pile or piles are joined together. Usually, rigid joining of the housings and piles is accomplished by filling the space therebetween with a settable, fluid cement or grout, requiring that the piles and housings have a long coextensive interval, but, even then, the bond and the rigidity of the connection is not always good, and washing and erosion of the cement can occur.

The present invention enables the rigid connection between the piles and the housing to be made by a forging or pile deforming operation which mechanically interlocks the components together to obviate the need for grouting, and enabling the coextensive housing and pile sections to be relatively shorter than in the case where cement or grouting is employed.

In addition, the invention enables the piles to be driven by pile drivers, if desired, rather than being set and cemented in bore holes, since the connection can be made without regard to a predetermined, relative axial position of the pile in the housing.

Figure 2:
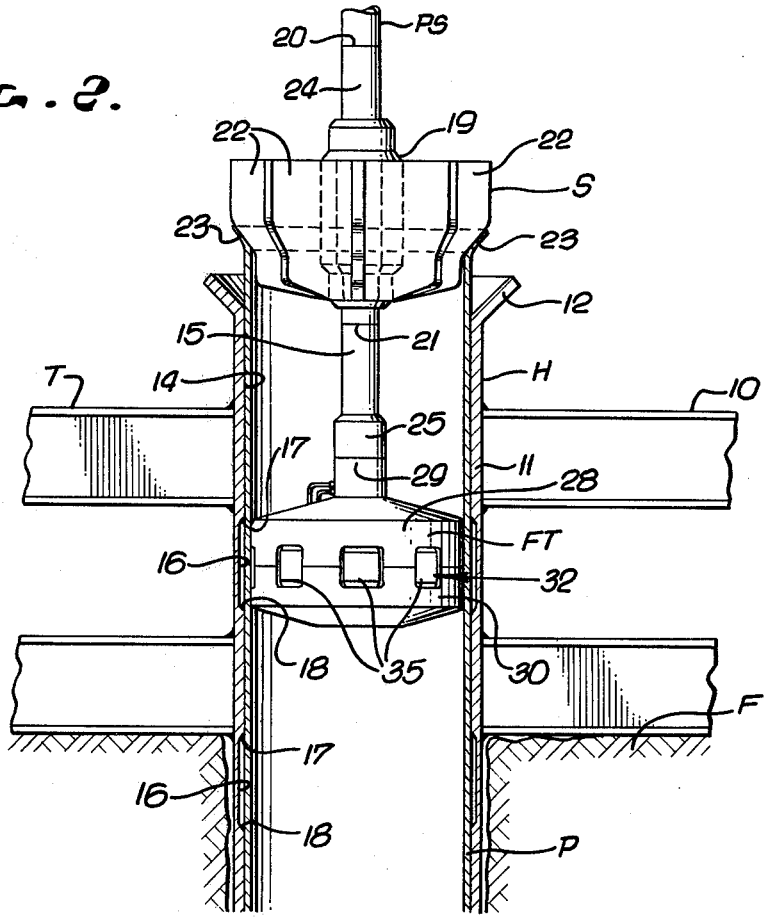
FIG. 2 is a vertical section on the line 2—2 of FIG. 1, with the forge tool and swivel shown in elevation.

Referring to FIG. 2, an illustrative pile housing H is snown as comprising an elongated tubular body 11 welded or otherwise rigidly connected to the frame structure 10 and extending some distance downwardly through the frame structure 10 into the floor F at the bottom of the water. At its upper end, the pile housing body 11 has an upwardly and outwardly flared guide mouth 12 which facilitates the lowering of a pile downwardly through the water from a work vessel V afloat at the top of the water. Such lowering of the pile P into position in the housing can be accomplished by any suitable and well known apparatus. The pile is either lowered into a drilled bore hole, which has been drilled through the pile housing H or the pile may be driven by a pile driver, if the earth formation below the floor of the water permits driving of the pile. In any event, the pile P is initially lowered through the pile housing and into the earth below the floor of the body of water to a location at which the upper section of the pile is disposed within the bore 14 of the housing body 11. It is then necessary that the upper end section of the pile and the pile housing H be interconnected in such a manner as to rigidly anchor the template or frame structure T in position.

According to one procedure utilizing the invention, a forge tool FT is lowered on a pipe string PS from the vessel V, afloat on top of the water, into the pile P, as shown in FIG. 2. The forge tool FT is connected to the pipe string below a marine swivel structure S by a connector pipe section 15 of selected length, whereby the position of the forge tool FT within the pile P and with respect to the housing H is determined when the swivel S lands upon the upper end of the pile section. The pile housing body 11 has one or a plurality of vertically spaced annular grooves 16 defined between downwardly and upwardly facing housing shoulders 17 and 18, into which grooves the pile P is to be deformed to effect an interlocking engagement between the pile and the housing.

The marine swivel S, as is well known, includes a body section 19 connected at 20 to the lower end of the pipe PS and connected at 21 to the extension or connector pipe 15. In the present case, the body 19 of the swivel is provided with a plurality of circumferentially spaced radially projecting supporting fins 22 providing downwardly and inwardly inclined shoulders 23 adapted to be landed in the upper end of the pile, as the forge tool FT is lowered downwardly through the pile. The body 19 of the pile, as is typical of such swivels, is enabled to remain stationary, while the central pipe section 24, which extends through the body 19 and is connected to the pipe PS and the extension pipe 15 is enabled to rotate within the stationary body 19. Such rotation of the pipe P, the swivel pipe 24 and the extension pipe 15 causes rotation of the forge tool FT to effect the forging operation to be described below.

Figure 5:
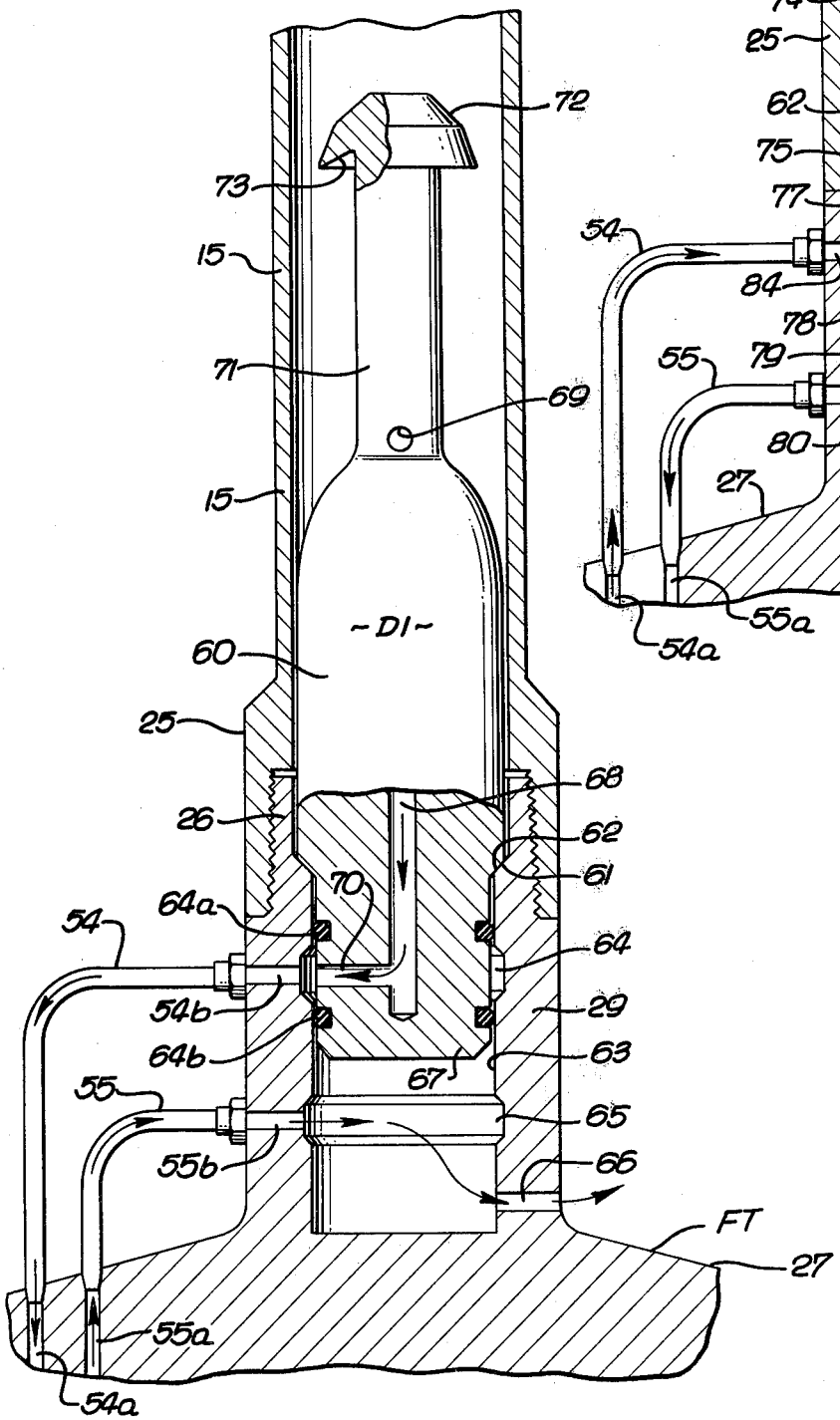
FIG. 5 is a fragmentary detail view partly in elevation and partly in section illustrating the operating fluid pressure control means including a dart for enabling expansion of the forge rollers.

The forge tool FT is connected to the extension pipe 15 by means of a suitable connector, having, as seen in FIG. 5 for example, an internally threaded box section 25 on the lower end of the extension pipe 15 engaged with an externally threaded pin 26 provided on the forge tool FT.

Figure 4:
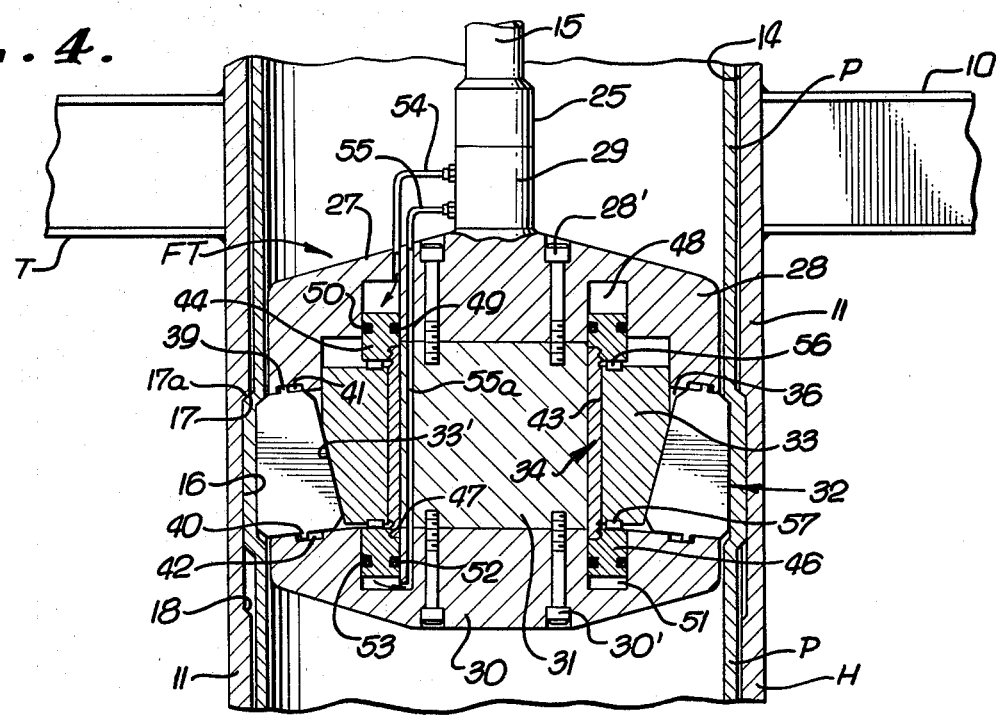
FIG. 4 is a fragmentary view corresponding with a portion of FIG. 3 illustrating the forge rollers expanded to deform the pile into the pile housing.
Figure 3:
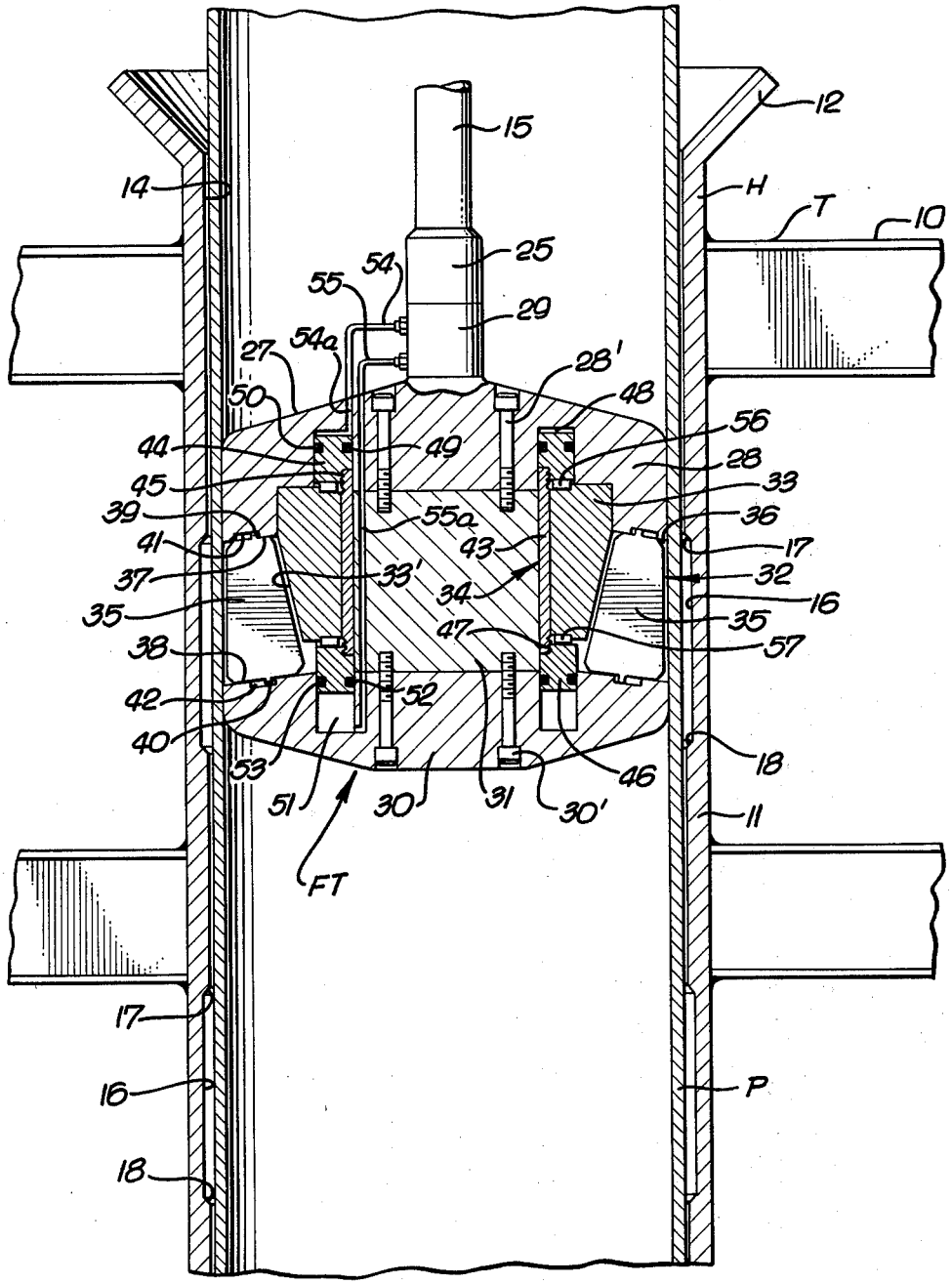
FIG. 3 is an enlarged fragmentary view, showing the forge tool in the condition and in the position of FIG. 2, with the forge rollers retracted.

The forge tool FT as illustrated in FIGS. 3 and 4 will be seen to comprise a body structure 27 composed of an upper body section 28 having a neck 29 located centrally thereof and connected to the extension pipe 15. The body structure 27 includes a lower body section 30 spaced from the upper body section 28 by a central cylindrical section 31. Suitable fasteners 28' connect the upper body section 28 to the top of the central body section 31, and suitable other fasteners 30' connect the lower body section 30 to the underside of the central body section 31. Prior to connection of one or the other of the body sections 28 to the central body section 31, a suitable number of circumferentially spaced forging rollers 32, a circumferentially extended expander 33 and actuator piston means generally denoted at 34 are installed in the other of the upper or lower body sections.

The forge rollers 32 each comprise a frusto-conical roller body 35 rotatably disposed in laterally opening windows 36 provided between the upper and lower body sections 28 and 30, the rollers 35 being disposed between an upper downwardly and outwardly inclined surface 37 provided at the top of the window 36 and a lower downwardly and outwardly inclined surface 38 forming the bottom of the window 36 and parallel with the upper surface 37, whereby the rollers have their axes downwardly and inwardly inclined and normal to the surfaces 37 and 38, with the outer circular surface of the rollers extending substantially longitudinally or parallel to the inside surface of the pile P and the inner surface of the rollers downwardly and inwardly inclined for engagement with the correspondingly downwardly and inwardly inclined external expander surface 33' of the actuator ring 33. Upper and lower end projections 39 and 40 are provided on the respective forge rollers 35 and extend into radially extended upper and lower recesses 41 and 42 formed in the upper and lower window surfaces 37 and 38, whereby displacement of the rollers outwardly from the windows during running of the forging tool is prohibited, but the rollers are nevertheless free for radial outward expansion upon actuation of the expander ring 33 by the actuator piston means 34.

The actuator or wedge means 33 is revolvably disposed about a cylindrical piston supporting member 43 which is reciprocable upon the central body section 31 and has an upper annular piston 44 mounted thereon, as by a threaded connection 45, and a lower annular piston member 46 mounted thereon, as by threaded connection 47. The annular upper piston 44 is reciprocably disposed in an annular piston chamber or cylinder 48, the piston 44 having an inner piston or side ring seal 49 and an outer piston or side ring seal 50 slidably and sealingly engaged with the opposed walls of the piston chamber. Correspondingly, the lower annular piston 46 is reciprocably disposed in an annular piston chamber or cylinder 51, and the piston 46 has an inner piston or side ring seal 52 and an outer piston or side ring seal 53 slidably and sealing engaged with the opposed cyliner walls of the piston chamber 51. Fluid under pressure is adapted to be supplied from the pipe, through the swivel and the extension pipe, to the respective piston chambers 48 and 51 via a pair of fluid conduits 54 and 55, through which pressure fluid can be alternately supplied to the respective piston chambers and exhausted therefrom. The upper body section 28 has a passageway 54*a* leading to the piston chamber 48 from the conduit 54, while a passageway 55*a* extends through the upper body section 28, the central body section 31 and the lower body section 30 into the lower piston chamber 51.

It will now be apparent that the application of pressure fluid through the conduit 54 to the upper piston chamber 48, while any fluid in the lower piston chamber 51 is being exhausted through the conduit 55, will cause the assemblage comprising the upper piston 44, the piston supporting sleeve 43 and the lower piston 46 to move downwardly, thereby applying a downward thrust to the expander ring 33. Such downward movement of the expander ring will cause engagement of the downwardly inclined wedging surface 33' thereon with the confronting circular surfaces of the forge rollers 35, causing outward expansion thereof into engagement with the interior of the pile P. During expansion, or after initial expansion of the forge rollers 35 into engagement with the pile P, the running pipe string is rotated, as permitted by the swivel structure S, whereby the forge rollers 35 rotatably engage the inner wall of the pile P, and as the tool is being rotated progressively deform the pile circumferentially outwardly, to the condition shown in FIG. 4, wherein the pile is provided with a shoulder 17*a* facing upwardly and engaged beneath the downwardly facing shoulder 17 of the pile housing.

As previously indicated, the cylinder connector sleeve or member 43 is rotatably disposed about the central body section 31. In addition, the wedge ring 33 is rotatably disposed about the piston connector sleeve 43, and preferably anti-friction bearings 56 are provided between the upper piston 44 and the upper end of the wedge ring 33 and anti-friction bearings 57 are provided between the lower end of the wedge ring 33 and the lower piston 46, thereby enabling relative freedom of rotation of the forge rollers as the entire tool is rotated to progressively forge the pile outwardly. Following the forging of the pile as seen in FIG. 4, the forge tool can be lowered to further forge the pile outwardly to effect engagement with the upwardly facing internal shoulder 18 within the housing. In a subsequent forging operation, the pile P may be deformed outwardly into the succeeding downwardly spaced grooves 16 of the housing, by repeating the forging operation described above.

Figure 6:
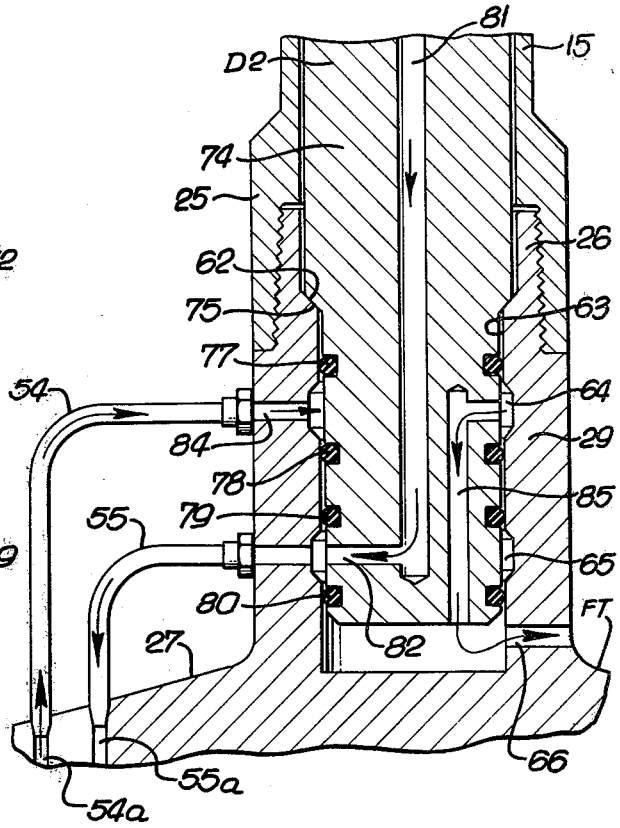
FIG. 6 is a fragmentary view corresponding to FIG. 5, but showing a releasing dart for enabling retraction of the forge rollers.

Referring to FIGS. 5 and 6, means are illustrated for causing the forge rollers 35 to be expanded and enabled to retract, in response to axial shifting of the wedge ring 33 in the respective opposite directions. As seen in FIG. 5, a dart D1 is provided which is adapted to cause the flow of operating fluid from the pipe 15 through the conduit 54 leading to the upper piston chamber 54, while the fluid in the lower piston chamber 51 can exhaust through the conduit 55. The dart D1 comprises a body 60 having a downwardly facing shoulder 61 engaged with an upwardly facing seat 62 within the neck 29 of the forge tool body. An elongated bore 63 is provided in the neck 29 having an upper annular groove 64 and a lower annular groove 65, with the upper groove communicating via a radial port 54*b* with the conduit 54, and the lower groove 65 communicating via a radial port 55*b* with the conduit 55. Below the lower groove 65 is a radial discharge port 66 provided in the body neck 29 leading from the bore 63 to the exterior thereof. A lower body section 67 of the dart body extends downwardly from the shoulder 62 into the bore 63, and has a pair of axially spaced side ring or O-ring seals 64*a* and 64*b* which span the upper groove 64 and isolate the groove 64 from the discharge port 66, while the port 55*b* establishes communication between the conduit 55 and the discharge port 66. Suitably formed in the body of the dark D1 is an elongated fluid passage 68 leading from an upper port 69 and communicating via one or more radial ports 70 with the annular groove 64 between the O-ring seals 64*a* and 64*b*, whereby pressure fluid supplied through the extension pipe 15 can flow through the dart and through the conduit 54 to the upper piston chamber 48, thereby forcing the upper piston 44 downwardly to effect expansion of the forge rollers 35 by the expander ring 33. The dart body 60 has a reduced, upwardly extended neck 71 provided with a recovery head 72 which has a downwardly facing shoulder 73 adapted to be engaged by the usual wireline retrieving tools, whereby the dart D1 can, when desired, be removed from the forge tool and retrieved to the vessel through the pipestring PS, following the outward forging of the pile P into mechanically interlocked engagement with the pile housing.

Referring to FIG. 6, a second dart D2 is shown. This dart D2 has, without requiring specific illustration, an upper end construction similar to that of the dart D1. At its lower end, the body 74 of the dart D2 has a downwardly facing shoulder 75 engageable with the upwardly facing shoulder 62 within the tool neck 29. Extending downwardly from the shoulder 75 into the bore 63 of the neck and bridging both of the annular grooves 64 and 65 in the neck is a reduced body section 76. This body section 76 has an upper set of axially spaced side or O-ring seals 77 and 78 disposed in sealing engagement within the bore 63 and spanning the upper annular groove 64. A lower set of axially spaced side or O-ring seals 79 and 80 sealingly engage within the bore 63 and span the lower annular groove 65. In this dart, the central fluid passage 81 therein extends downwardly and communicates through a radial port 82 with the annular groove 65, whereby, as shown by the arrows, pressure fluid can be supplied through the conduit 55 leading to the lower piston chamber 51, whereby to forcibly shift the expander ring 33 upwardly, as fluid in the upper piston chamber 48 is discharged through the conduit 54, finding access to the annular groove 64 in the neck 29 through a radial port 84 in the neck, the fluid flowing through the annulus and into a passageway 85 leading from the annulus to a longitudinally extended further passageway 85 which discharges into the bore 63 below the lower end of the dart, and thence discharges through the discharge port 66 to the exterior of the assembly.

Figure 7:
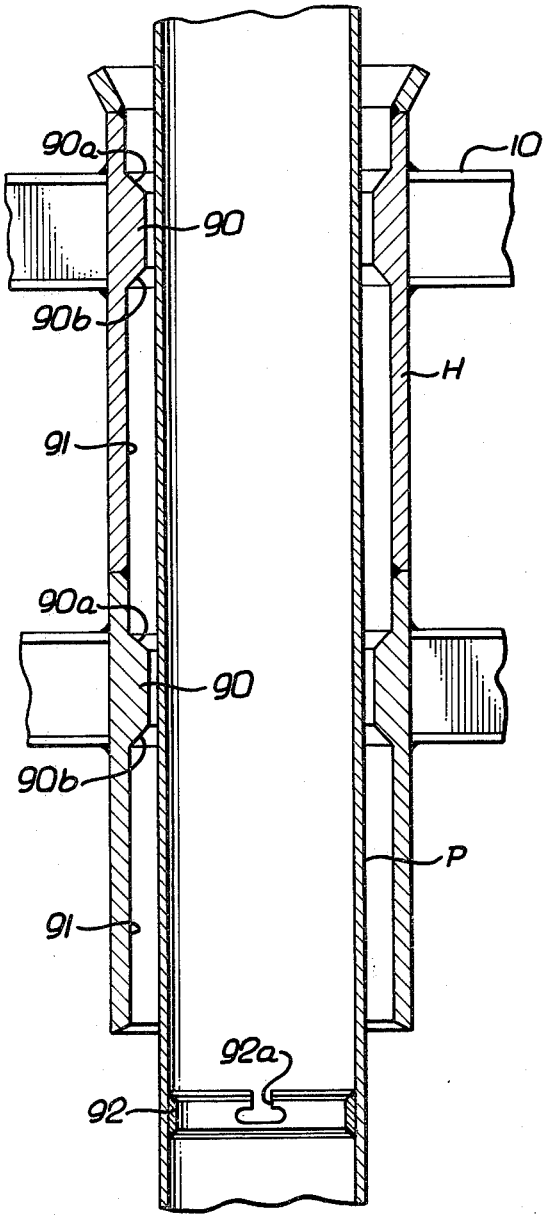
FIG. 7 is a view showing an initial step in a pressure forging method for installing the pile in the pile housing.
Figure 8:
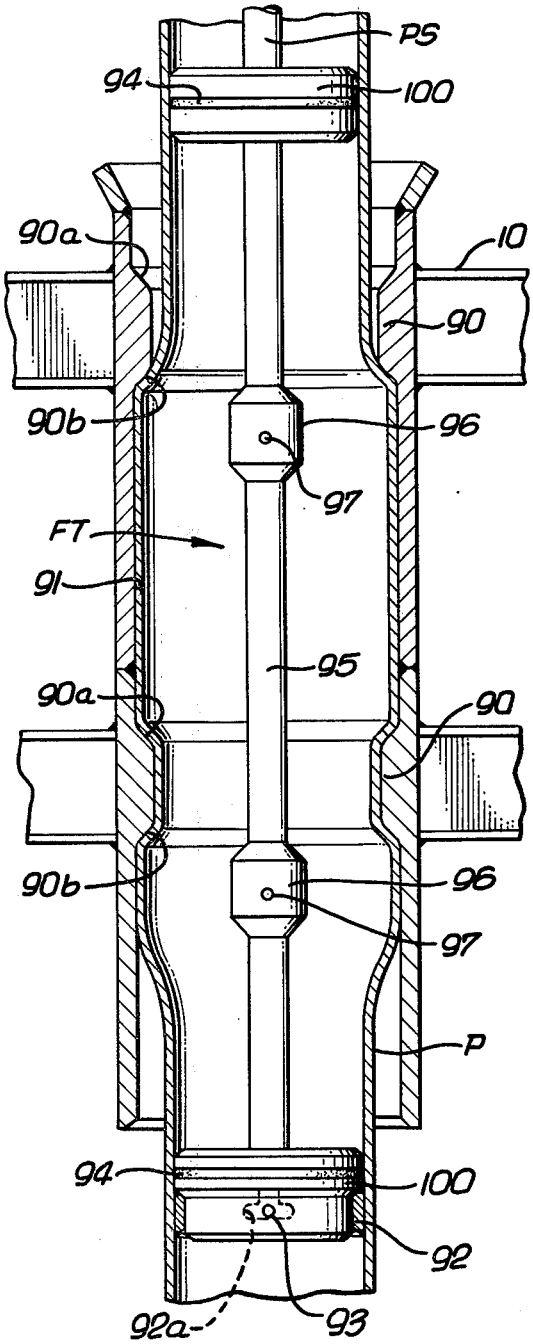
FIG. 8 is a view corresponding to FIG. 7 but showing a tool installed in the pile for explosively expanding the pile into the housing.

Referring to FIGS. 7 and 8, another mode of installing the pile P in one or more housings H is illustrated. Here again, the housing H is integrated with the frame structure 10. Internally, the housing provides a number of vertically spaced ribs or lands 90 providing upwardly facing shoulders 90*a* and downwardly facing shoulders 90*b*, with intervening annular bores or channels 91 into which the pile P is to be deformed by means FT adapted to apply an outward deforming force to the section of pile located within the housing.

In this form, the forge tool FT is adapted to effect expansion of the pile section by high pressure applied internally of the pile section. As seen in FIG. 8, the tool FT is run into the pile section on the length of pipe PS and located with respect to the lands 90 by means of a landing and anchoring collar 92 provided in the pile section and having a J-lock slot 92*a* adapted to receive a J-lock pin 93 for positioning and holding the tool in place in the pile.

The tool FT has upper and lower sealing devices 100, such as well known high pressure well bore packers adapted to be disposed in and to form a seal with the interior of the pile by engagement of a sealing element 94 carried by the devices 100 with the inner pile wall. A length of pipe 95 extends between the sealing packers 100 and has pressure generating units 96 in axially spaced relation, provided with pressure outlets 97, through which pressurized fluid or gas is admitted to the interval between the sealing units 100.

As is well known, pressure can be generated by the use in the units 96 of a gas generating material, such as an explosive or propellant material which can be activated or initiated by suitable means, such as a squib fired by a tool dropped through the pipestring PS or by a wireline tool. The details of the means for generating pressure within the pile are not germane to the invention and are, therefore, not specifically illustrated, since those skilled in the art are aware of the use of high pressure devices of the explosive or propellant types useful in well bore operations.

The significant aspect of the apparatus illustrated in FIGS. 7 and 8 is that the tool FT provides a means whereby pressure can be generated in the pile, between the seals 100, and the pile is deformed outwardly and has downwardly and upwardly facing shoulders 90*c* and 90*d* engaged with the housing shoulders 90*a* and 90*b*, to rigidly anchor the frame and housing structure to the pile and, thus, to the bottom of the water.

I claim:

1. The method of anchoring a frame structure on the floor of a body of water comprising: disposing a pile in a pile housing in the frame structure with the pile extending from the housing and into the earth below the floor, said housing having a circumferential recess therein; lowering from the surface of the water a rotatable pipe string having a fluid pressure expansible forge tool at the lower end of the pipe string; positioning said forge tool on said pipe string in said pile and with respect to said recess; centering said forge tool in said pile on a swivel seated on said pile, applying fluid pressure through said pipe string to expand said forge tool while rotating said pipe string and said forge tool in said swivel and deforming said pile into said recess; contracting said forge tool and removing said forge tool and said swivel on said pipe string from said pile.

* * * * *